US005947767A

United States Patent [19]

Kitamura et al.

[11] Patent Number: 5,947,767

[45] Date of Patent: Sep. 7, 1999

[54] ELECTRICAL CONNECTOR

[75] Inventors: Shigeyasu Kitamura; Akira Kasuga; Shigenori Koike, all of Tokyo, Japan

[73] Assignee: KEL Corporation, Tokyo, Japan

[21] Appl. No.: 08/984,712

[22] Filed: Dec. 3, 1997

[30] Foreign Application Priority Data

Dec. 4, 1996 [JP] Japan ..... 8-323743

[51] Int. Cl.[6] ..... H01R 13/60

[52] U.S. Cl. ..... 439/567; 439/571

[58] Field of Search ..... 439/567, 566, 439/569, 570, 571, 607, 626, 870, 871, 872, 248, 374, 712, 533.1, 536, 736, 82, 83

[56] References Cited

U.S. PATENT DOCUMENTS

| | | | |
|---|---|---|---|
| 4,854,890 | 8/1989 | Nishimura | 439/607 |
| 4,881,904 | 11/1989 | Ammon et al. | 439/712 |
| 4,943,244 | 7/1990 | Teck et al. | 439/567 |
| 5,104,326 | 4/1992 | Smith et al. | 439/607 |
| 5,163,851 | 11/1992 | Hart et al. | 439/567 |
| 5,238,413 | 8/1993 | McCaffrey et al. | 439/571 |
| 5,238,429 | 8/1993 | Margrave et al. | 439/736 |
| 5,713,755 | 2/1998 | Koopman et al. | 439/571 |
| 5,727,970 | 3/1998 | Koguchi et al. | 439/607 |
| 5,772,474 | 6/1998 | Yagi et al. | 439/736 |
| 5,807,135 | 9/1998 | Clark | 439/567 |

FOREIGN PATENT DOCUMENTS 8-69838 3/1996 Japan .

*Primary Examiner*—Eugene Eickholt
*Attorney, Agent, or Firm*—Robert W J Usher

[57] ABSTRACT

An electrical connector has an insulative housing, a fixture, and a shield. The fixture is used for fixing this insulative housing on a circuit board, and the shield is to cover the insulative housing. The insulative housing, which is made of an electrically insulating material, comprises a main body and an engaging portion, which protrudes forward from the main body to engage with a matable connector. The insulative housing also comprises fixture retaining slots, which extend through the main body in the vertical or to-and-fro direction at the lateral ends of the main body of the housing. Into each of these fixture retaining slots, a fixture, which is made of an electrically conductive metallic material, is press-fit to fix the insulative housing onto a circuit board. The shield, which is made of an electrically conductive metallic material, comprises a peripheral portion and contact portions in a one-piece body. The peripheral portion covers the perimeter of the engaging portion of the insulative housing, and each of the contact portions extends into a respective fixture retaining slot. With this construction, each fixture is retained in contact with a respective contact portion in a respective fixture retaining slot grounding the shield when the electrical connector is mounted on a circuit board with the fixtures being surface-mounted onto grounding pathways on the circuit board.

6 Claims, 7 Drawing Sheets

ELECTRICAL CONNECTOR

RELATED APPLICATIONS

This application claims the priority of Japanese Patent Application No. 08-323743 filed on Dec. 4, 1996, which is incorporated herein by reference.

FIELD OF THE INVENTION

The present invention relates to an electrical connector of a type which is mounted on a printed circuit board, and more particularly to an electrical connector whose insulative housing is covered with a metallic shield (or shell).

BACKGROUND OF THE INVENTION

This type of electrical connector has been known in the art. One such electrical connector is disclosed in Japanese Laid-Open Patent Publication No. H8(1996)-69838. This electrical connector is designed such that after the housing of the electrical connector is placed on a surface of a printed circuit board, the lead portions of the contacts of the electrical connector are soldered to electrically conductive pathways of a circuit pattern which is provided on the circuit board. This electrical connector is constructed such that the end portions (or fixing portions) of a metallic shell which extends laterally over the housing are soldered to grounding pathways provided on the circuit board to ground the electrical connector. In this type of electrical connector, the fixing portions of the electrical connector, which are connected to the grounding circuit of the printed circuit board, are formed in a one-piece body with the shell.

To provide anti-corrosion protection, and thereby to improve the durability of the electrical connector, it is customary to provide this metallic shell with plating. As the shell of the electrical connector comes into contact with the corresponding shell of a matable connector when these two connectors are intermated, it is necessary to harden the surface of the shell for the purpose of improving the durability. Thus, it is typical that nickel plating is applied for this purpose.

However, if the whole shell is plated with nickel, including the fixing portions, which are to be soldered onto respective pathways of the printed circuit board as described above, then the soldering of the shell to the printed circuit board is made difficult because of the nickel plating of the fixing portions. One way to circumvent this problem is that the nickel plating may be applied only to the main body of the shell excluding the fixing portions, and solder plating may be applied to the fixing portions instead. However, it is difficult to practice such a separate plating. If the plating process were attempted in such a way, then the process can be very complicated and may raise the price of the electrical connector substantially.

Alternatively, the fixing portions may be formed as a separate part from the shell, for example, as a fixture, and the main body of the shell and these separately formed fixing portions may be plated separately in the manner described above before they are assembled to the housing of the electrical connector. For example, as shown in FIG. 7, the fixture 98 may comprise a main body 98*a*, which is formed in a U-like cross section, and a fixing portion 98*b*, which is provided on the lower end of the main body 98*a* such that the fixture 98 is capable of attaching itself to a printed circuit board K. This fixture may be fit over an insulative housing 91 by translating the fixture upward. Also, the shell 92 may include a holding part 92*a*, which is formed also in a U-like cross section, and this shell 92 is fittingly placed over the insulative housing 91 and the fixture 98. In this way, the shell 92 and the fixture 98 can be retained in connection.

However, in this construction, the holding part 92*a* of the shell 92 needs much resiliency to hold the other parts inside. Thus, the production of the shell 92 and the assembly of the shell 92 to the fixture 98 are not simple. In addition, if a force acts to open the holding part 92*a* outward (shown by arrow O in the figure), there will be a problem of contact failure between the holding part 92*a* of the shell and the main body 98*a* of the fixture.

SUMMARY OF THE INVENTION

The present invention is conceived to solve the problems mentioned above. It is an object of this invention to provide an electrical connector which is easily fabricated and assembled yet whose shield has an improved durability, and which enables secure and easy electrical grounding connection with a printed circuit board.

The above object of the present invention is realized by an electrical connector which comprises an insulative housing, fixtures, and a shield. The fixtures are used to fix the insulative housing on a circuit board, and the shield is to cover the insulative housing. The insulative housing, which is made of an insulative material, comprises a laterally extending main body, and an engaging portion, which protrudes forward from this main body to engage with a matable connector. This insulative housing further comprises fixture retaining slots, which are provided through the main body of the insulative housing in a vertical or to-and-fro direction near the lateral ends of the main body.

Into each of these fixture retaining slots, one of the fixtures, which are made of an electrically conductive metallic material, is press-fit. These fixtures are used to fix the insulative housing onto a circuit board. The shield, which is made of an electrically conductive metallic material, comprises a peripheral portion, which covers the perimeter of the engaging portion of the insulative housing, and contact portions, which are formed in a one-piece body with the peripheral portion, each extending from the peripheral portion to a respective one of the fixture retaining slots of the insulative housing. In this construction, one fixture and one contact portion of the shield are retained in contact with each other in one of the fixture retaining slots, maintaining electrical connection between them, respectively.

With this construction, the shield of the electrical connector is electrically grounded when the electrical connector is mounted on a respective circuit board, and the fixtures of the electrical connector are surface-mounted on the grounding pathways which are provided on the circuit board. In this construction, the fixtures and the shield are separate parts, so they can be provided individually with a different surface treatment. Furthermore, as the fixtures and the contact portions of the shield are maintained electrically connected to one another in the fixture retaining slots, there is no need to provide resiliency to these parts, and there is no concern of contact failure as they will not part from each other even if any outside force should act to separate them.

In this electrical connector, it is preferable that the fixtures be plated with a solder so that the fixtures will be easily soldered to the grounding pathways of the circuit board. It is also preferable that the shield be plated with a hard plating to harden the surface of the shield which comes in contact with a corresponding part of a matable connector so that the improved hardness of the shield will improve the durability of the electrical connector. For this purpose, nickel plating or hard chrome plating is recommended for the above mentioned hard plating.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention and wherein.

DESCRIPTION OF THE PREFERRED EMBODIMENTS

Figure 1A:
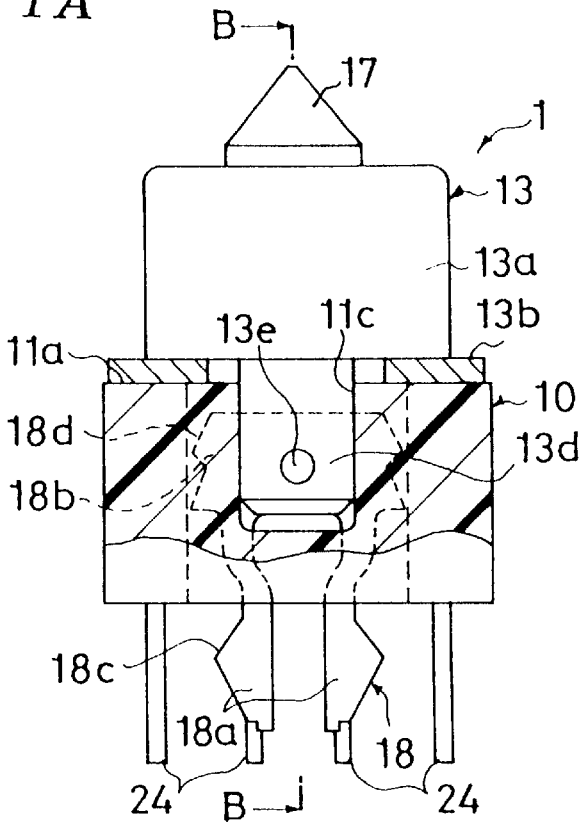
FIGS. 1A and 1B are partial cross-sectional views of an electrical connector according to the present invention, describing a portion which enables grounding connection, FIG. 1A showing a cross-sectional view of the electrical connector, taken along line A—A in FIG. 1B, and FIG. 1B showing a cross-sectional view taken along line B—B in FIG. 1A.
Figure 1B:
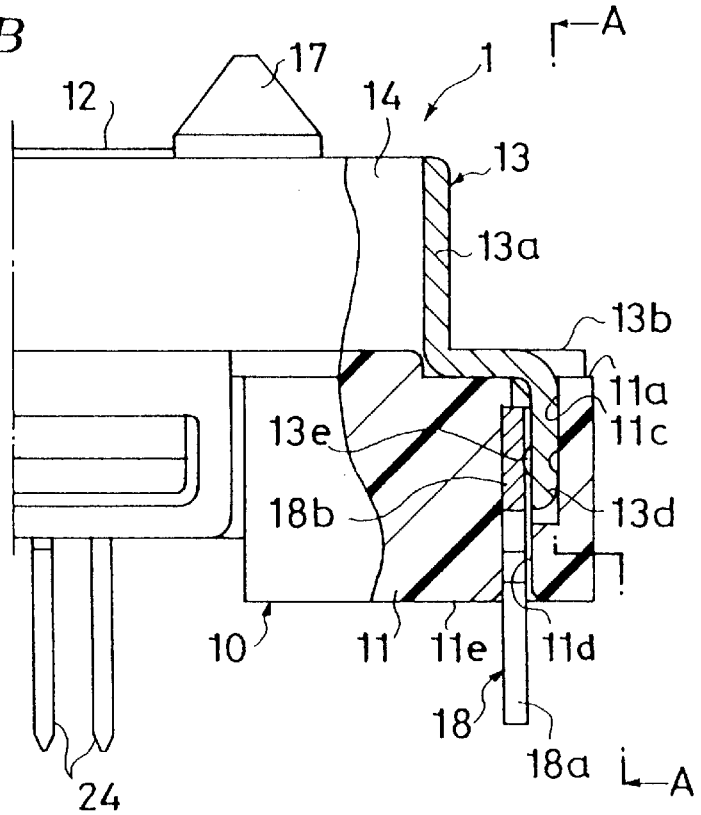
Figure 2:
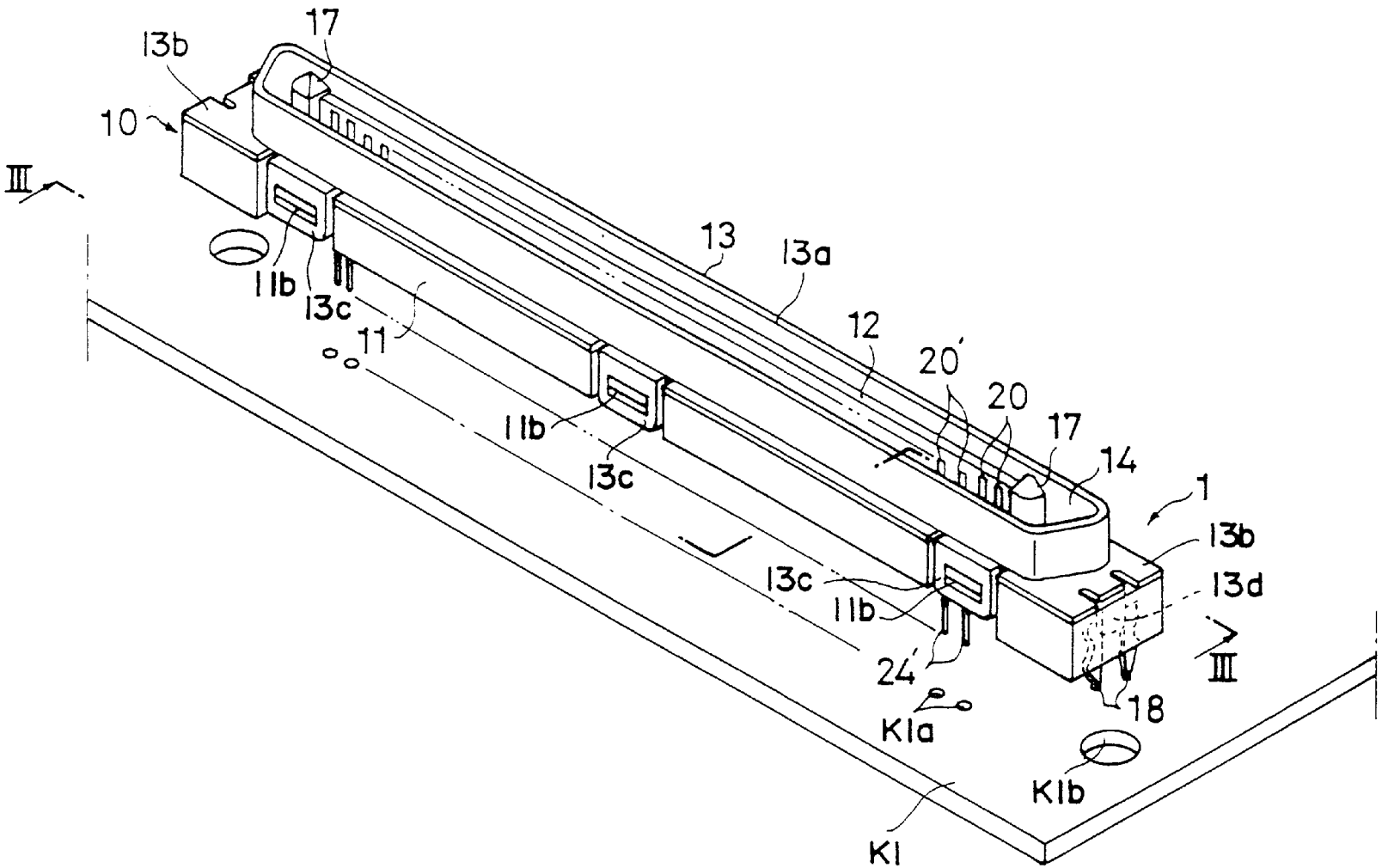
FIG. 2 is a perspective view of a plug connector, which is an example of the electrical connector.
Figure 3:
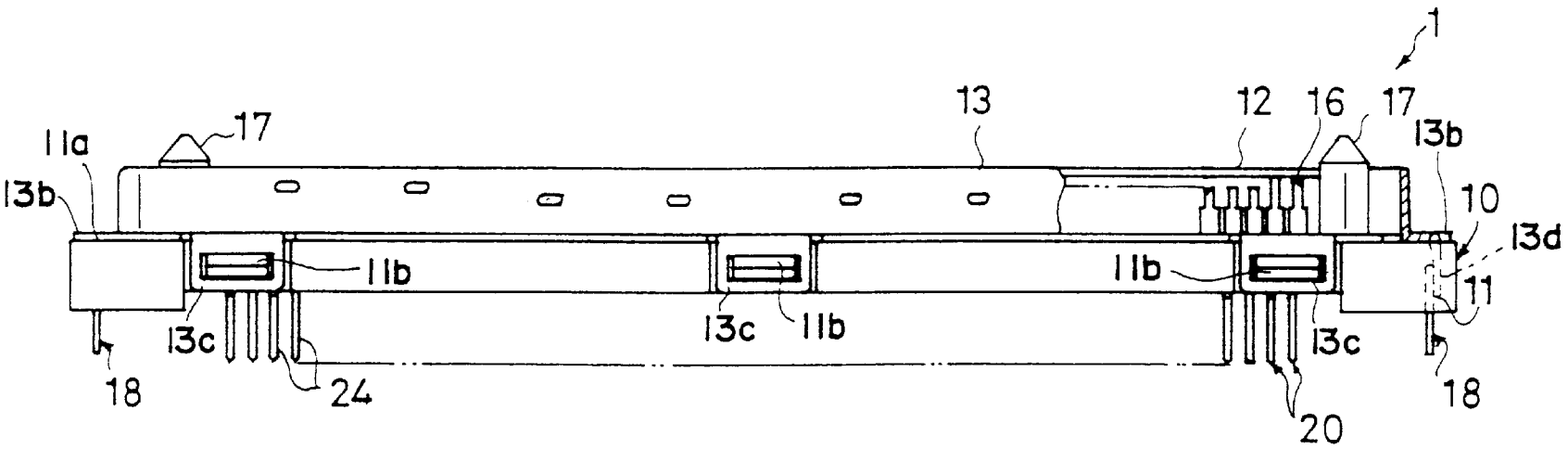
FIG. 3 is a cross-sectional view of the plug connector, taken along line III—III in FIG. 2.

An electrical connector according to the present invention is described below as a plug connector and a receptacle connector. These connectors are matable with each other. First, a description of the plug connector is given referring to FIGS. 1, 2 and 3. The plug connector 1 comprises a plug housing (i.e., insulative housing) 10, which is made of an insulating material, and a plurality of plug contacts 20, which are retained in the plug housing 10. The housing 10 comprises in a one-piece body a housing main body (or main body) 11, which has a figure of rectangular bar, and a plug contact retaining portion (i.e., engaging portion) 12, which has a figure of rectangular box, protruding upward on the housing main body 11.

The upper surface of this housing main body 11 is covered with a shell (or shield) 13. This shell 13, which is made of a metallic plate for electrical conductivity and durability, comprises an outer peripheral portion 13*a*, lateral horizontal portions 13*b*, a plurality of holding portions 13*c*, and contact portions 13*d*. The outer peripheral portion 13*a* extends upward surrounding the periphery of the plug contact retaining portion 12, and the horizontal portions 13*b* extend horizontally from the lower end of the outer peripheral portion 13*a* at the lateral ends thereof to cover the upper face 11*a* of the lateral ends of the housing main body 11. The holding portions 13*c* extend from the lower front and rear ends of the outer peripheral portion 13*a* downward to hold the front and rear faces of the housing main body 11. The contact portions 13*d* extend from the horizontal portions 13*b*, bending downward into the housing main body 11.

The shell 13, after being plated with nickel, which is a type of hard plating, is placed on the housing main body 11 with the holding portions 13*c* holding the front and rear faces of the housing main body 11. More, specifically, a slot which is provided in each of the holding portions 13*c* of the shell engages with one of the shell-locking bosses 11*b* which are provided on the front and rear faces of the housing main body 11. This engagement prevents parting of the shell 13 from the housing main body 11, and the shell 13 is firmly fixed on the housing main body 11. In this condition, a plug space 14 opening upward is created above the housing main body 11 with the shell 13 surrounding the space.

Furthermore, the housing main body 11 is provided with contact portion insertion slots 11*c*, which are located in the upper face 11*a* at the lateral ends of the housing main body 11. Each of the contact portion insertion slots 11*c* is rectangular with a width and a thickness which can accept the insertion of a respective contact portion 13*d* of the shell 13. In addition, the housing main body 11 is provided with fixture retaining slots 11*d*, which extend upward into the housing main body 11 from the lower face 11*e* thereof. Each of the fixture retaining slot 11*d* has a width and a thickness which can accept the insertion of an embedded portion 18*b* of a fixture 18. Each slot is located adjacent to a respective contact portion insertion slot 11*c* on the side of the center of the housing main body 11 such that the upper portion of each fixture retaining slot 11*d* merges with the respective contact portion insertion slot 11*c*. Each fixture retaining slot 11*d* and respective contact portion insertion slot 11*c* are together referred to as a "fixture retaining slot" in claims.

The contact portions 13*d* of the shell 13 are inserted into these contact portion insertion slots 11*c*. Each contact portion 13*d* extends downward in a rectangular figure, and a contact boss 13*e* is provided on the contact portion 13*d*, protruding toward the center of the shell 13. Therefore, when the shell 13 is assembled to the housing main body 11 by the insertion of the contact portions 13*d* of the shell into the contact portion insertion slots 11*c* of the housing main body, each of the contact bosses 13*e* protrudes to a respective fixture retaining slot 11*d*.

The above mentioned fixture 18, which is made of a copper plate, has a U-like figure and comprises an embedded portion 18*b* and an insertion portion 18*a*. The insertion portion 18*a* branches out into two legs from the embedded portion 18*b*. These two legs are resilient and elastically bendable in the to-and-fro direction of the plug connector 1 (i.e., in the lateral direction in FIG. 1A), and they are provided with outward protrusions 18*c*. Therefore, while the insertion portions 18*a* of the plug connector 1 are being inserted into apertures K1*b* which are provided on a printed circuit board K1 for the mounting of the plug connector 1, these legs will close for easy insertion. However, once they are inserted into the apertures K1*b*, they will open with the protrusions 18*c* preventing the plug connector 1 from detaching from the printed circuit board K1.

These fixtures 18 are solder-plated and press-fit upward into the fixture retaining slots 11*d* from the lower face 11*e* of the housing main body 11, and they are retained therein. Retaining protrusions 18*d* are provided on the side edges of the embedded portion 18*b* of the fixture 18 to allow easy press-fitting but to prevent the fixture 18 from getting out. When the embedded portion 18*b* of each fixture 18 is press-fit in a respective fixture retaining slot 11*d* of the housing main body 11, the embedded portion 18*b* comes into contact with the contact boss 13*e* of a respective contact portion 13*d* of the shell 13, and the insertion portion 18*a* of each fixture 18 protrudes downward from the lower face 11*e* of the housing main body 11.

At the lateral ends of the plug contact retaining portion 12, guide protrusions 17 are provided in a one piece body with the plug contact retaining portion 12. The top end of each of these guide protrusions 17 is cone-shaped such that the insertion of the plug connector 1 to the receptacle connector 5, which will be described in detail later, is made easy as the guide protrusions 17 will guide the mating of the plug connector 1 to the receptacle connector 5.

Into the portion of the housing main body 11 which is located below the plug space 14, a plurality of plug contacts 20 are press-fit from the lower face 11*e* of the housing main body 11. In this process of press-fitting, the upper portions of these plug contacts are inserted into contact retaining grooves 16 which are provided in the rear and front sides of the plug contact retaining portion 12.

This plug connector 1, which comprises the plug housing 10 and the shell 13 as described above, is mounted on the printed circuit board K1, and the lead portions 24 of the plug contacts 20 are inserted into through-holes K1*a* which are provided on the printed circuit board K1 and are soldered to respective electrically conductive pathways of a circuit pattern (not shown) which is provided on the printed circuit board K1. At the same time, the insertion portions 18*a* of the fixtures 18, which are provided at the lateral ends of the plug housing 10, are inserted into apertures K1*b* which are provided on the printed circuit board K1 and are soldered to respective electrically conductive pathways for grounding (not shown). By this insertion and soldering of the respective parts, the plug connector 1 is firmly fixed on the printed circuit board K1.

In this condition, the shell 13 is grounded (or earthed) through the contact bosses 13*e* of the contact portions 13*d* of the shell 13 because the contact bosses 13*e* are in contact with the fixtures 18, which are electrically connected to the grounding pathways of the printed circuit board K1. As the shell 13 and the fixtures 18 are fabricated as separate parts, the shell 13 is plated with nickel while the fixtures 18 are plated with a solder. This nickel plating is to increase the durability of the shell against wear and tear which may be caused by repeated mating or insertion and removal with a matable connector, and the solder plating is to make easy the subsequent soldering of the plug connector 1 to a printed circuit board. In this way, the productivity of the fabrication of the plug connector 1 can be increased while the electrical connection between the shell 13 and the fixtures 18 is maintained.

Furthermore, even though the contact portions 13*d* of the shell 13 and the embedded portions 18*b* of the fixtures are not provided with any resiliency, they are kept firmly in contact with each other because they are press-fit and retained in the rectangular slots 11*c* and 11*d* of the housing main body 11, which has some resiliency. Even if any outside force should act on the contact portion 13*d* or on the embedded portion 18*b* in a direction to depart one from the other, they will not part from each other. Because of this firmness, the construction of the contact portion 13*d* and the embedded portion 18*b* may be made even simpler. It is not necessary to provide the contact bosses 13*e* on the contact portions 13*d* of the shell 13, and such parts can be provided instead on the embedded portions 18*b* of the fixtures 18.

Figure 4A:
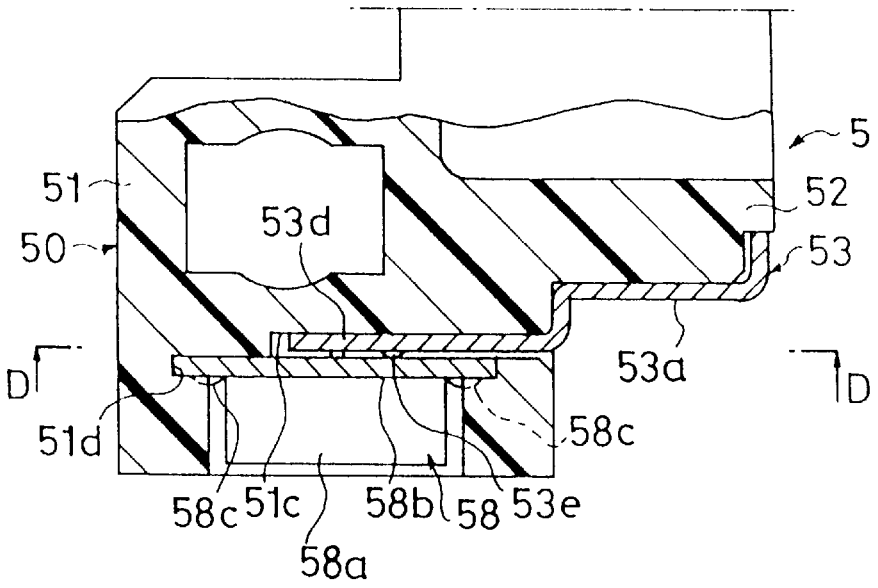
FIGS. 4A and 4B are partial cross-sectional views of a right-angle type receptacle connector, which is another example of the electrical connector, describing a portion which enables grounding connection, FIG. 4A showing a cross-sectional view taken along line C—C in FIG. 4B, and FIG. 4B showing a cross-sectional view taken along line D—D in FIG. 4A.
Figure 4B:
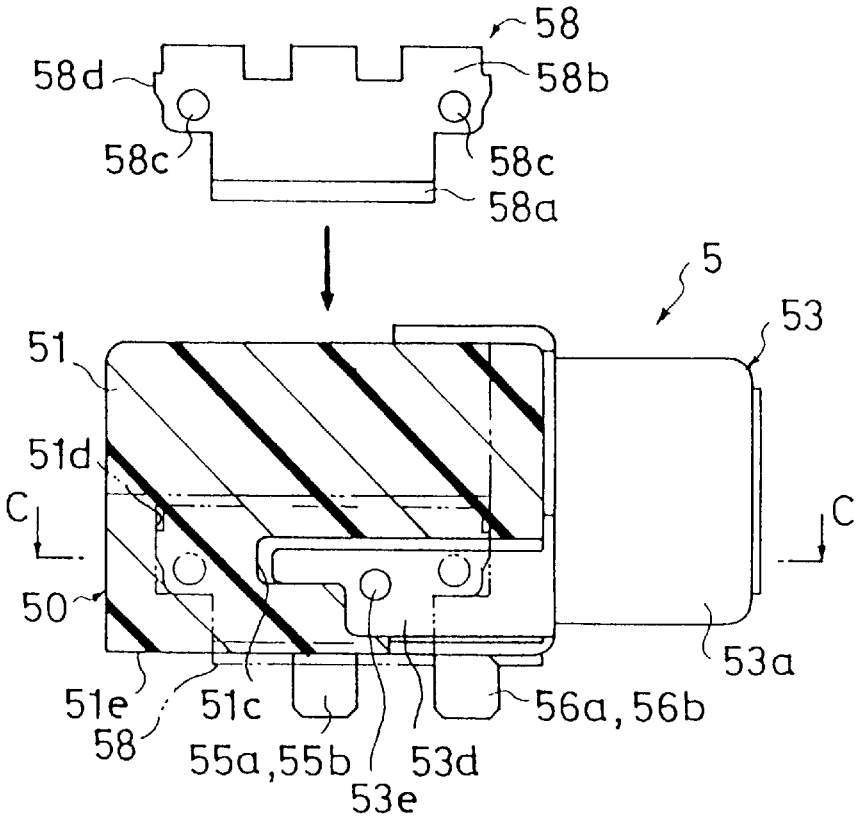
Figure 5:
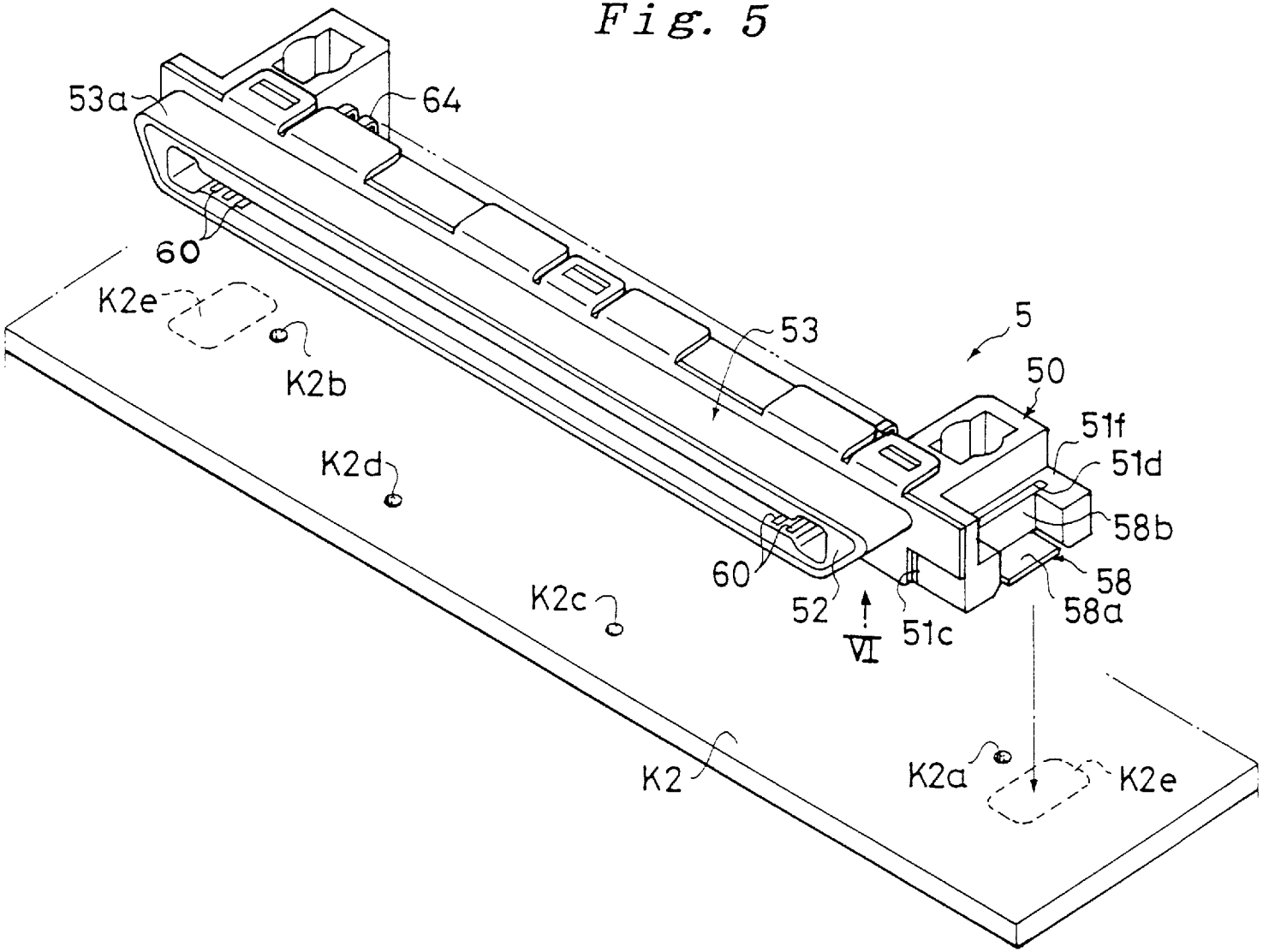
FIG. 5 is a perspective view of the right-angle type receptacle connector.
Figure 6:
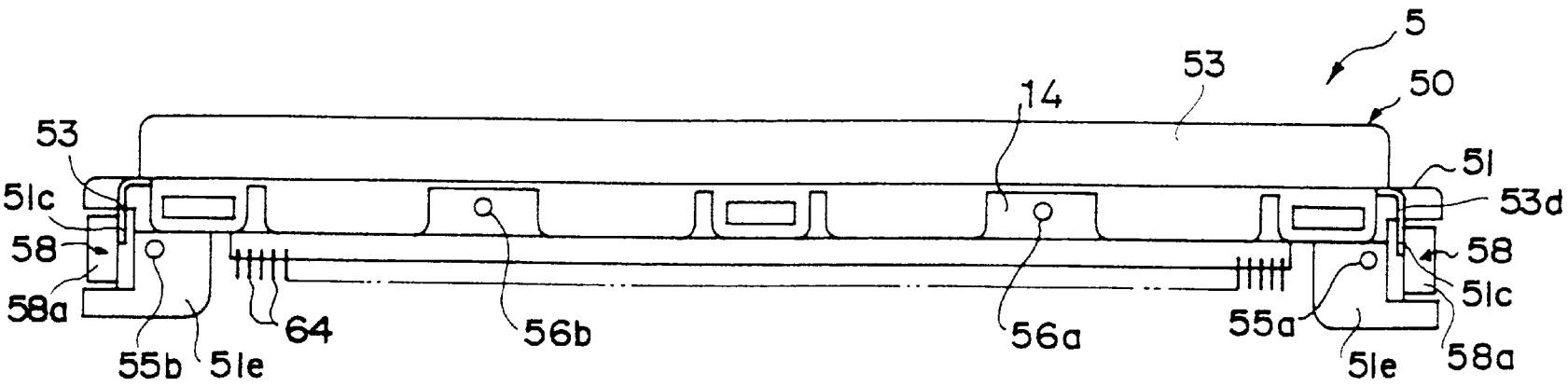
FIG. 6 is a bottom view, which is seen in the direction indicated by arrow VI in FIG. 5.
Figure 7:
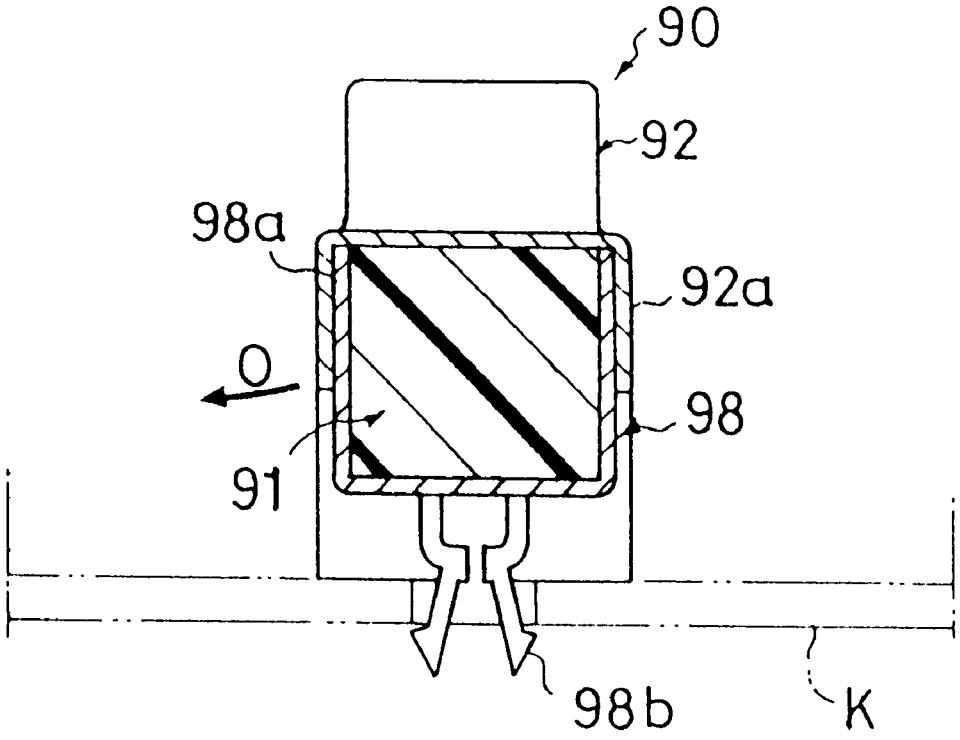
Fig. 7 PRIOR ART
FIG. 7 is a cross-sectional view of an electrical connector of prior art, showing a grounding portion thereof.

Now, the electrical connector according to the present invention is described as a receptacle connector (i.e., surface-mounted right-angle type connector) 5 with reference to FIGS. 4, 5 and 6. This receptacle connector 5 comprises a housing 50 and a plurality of contacts 60, which are retained in alignment in the housing 50.

The housing 50 comprises a housing main body 51, which is made of an insulating material, and a metallic shell 53, which covers the housing main body 51. The contacts 60 are retained in alignment in a guide housing 52 which protrudes forward in the center of the housing main body 51. At the lateral ends of the housing main body 51 outside the guide housing 52, metallic (copper) fixtures 58 are provided in a cross section of approximate L figure, with their lower ends extending outward.

The shell 53 is made of an iron plate for electrical conductivity and durability in the same way as the shell 13 previously described. The peripheral portion 53*a* of the shell 53 covers the lateral perimeter of the guide housing 52. Some upper and lower portions of the shell 53 cover and hold some upper and lower portions of the housing main body 51 in a similar manner as the shell 13 previously described.

The shell 53 includes contact portions 53*d*, which extend rearward at the lateral ends of the shell 53. When the shell 53 is assembled to the housing main body 51, these contact portions 53*d* are inserted into and retained in the contact portion insertion slots 51*c* which are provided in the housing main body 51, extending rearward from the front face. Each of the contact portion insertion slots 51*c* has a width and a thickness which can accept the insertion of the contact portion 53*d*. Moreover, the housing main body 51 includes fixture retaining slots 51*d*, which extend vertically through the upper face 51*f* of the housing main body 51 at the lateral ends thereof outwardly next to the contact portion insertion slots 51*c*. In this construction, each of the fixture retaining slots 51*d* merges with a respective one of the contact portion insertion slots 51*c*. Each fixture retaining slot 51*d* has a width and a thickness which can accept the insertion of the embedded portion 58*b* of the fixture 58.

The contact portions 53*d* of the shell 53, which are inserted into the contact portion insertion slots 51*c*, extend rearward, and each of the contact portions 53*d* includes a contact boss 53*e*, which protrudes outwardly to a respective fixture retaining slot 51*d*. Therefore, when the shell 53 is assembled to the housing main body 51 by the insertion of the contact portions 53*d* into the contact portion insertion slots 51*c*, each contact boss 53*e* protrudes to a respective fixture retaining slot 51*d*.

Each of the above mentioned fixtures 58, which are made of a copper plate, has a L-like figure and comprises an embedded portion 58*b* and an mounting portion 58*a*. The mounting portion 58*a* extends downward from the embedded portion 58*b* and bends outward. These fixtures 58 are plated with a solder and then press-fit downward into the fixture retaining slots 51*d* as shown in FIG. 4B, from the position shown in the real line to the position shown in the broken line.

Furthermore, each fixture 58 includes protruding retainers 58*c* and 58*d*, which are provided near the lateral ends of the embedded portion near the mounting portion 58*a*. These protruding retainers 58*c* and 58*d* are to prevent detachment of the fixture while allowing easy press fitting. When the embedded portions 58*b* of the fixtures 58 are press-fit into the fixture retaining slots 51*d* of the housing main body 51, the embedded portions 58*b* come into contact with the contact bosses 53*e* of the shell 53, and the mounting portions 58*a* of the fixtures 58 are positioned below the lower face 51*e* of the housing main body 51.

The guide housing 52 includes a plurality of contact retaining grooves 53 in alignment, each groove extending through the guide housing 52 from the front to the rear, and a contact 60 is retained in each contact retaining groove 53. Moreover, the guide housing 52 is provided with positioning bosses 55*a* and 55*b* and bend prevention bosses 56*a* and 56*b*. These bosses protrude downward on the lower face of the guide housing 52.

The positioning bosses 55*a* and 55*b* are inserted or press-fit into positioning apertures K2*a* and K2*b* which are provided on a printed circuit board K2 to position the receptacle connector 5 on the printed circuit board K2. The bend prevention bosses 56*a* and 56*b* are inserted into bend prevention apertures K2*c* and K2*d* which are provided also on the printed circuit board K2 to prevent the receptacle connector 5 from bending especially when the receptacle connector 5 is mated with the plug connector 1.

Each of the contacts 60 comprises a contact portion and a lead portion. The contact portions of the contacts 60 are aligned in upper and lower rows with a predetermined clearance between them, and each contact portion extends horizontally rearward. From the end of the contact portion, the lead portion 64 extends downward to the lower face of the housing and then bends and extends horizontally rearward a little below the lower face 51*e* of the housing. With this arrangement, the lead portions come in contact with respective electrically conductive pathways of a circuit pattern (not shown) which is provided on the printed circuit board K2 when the housing 50 of the receptacle connector 5 is mounted on the printed circuit board K2.

The receptacle connector 5, which is constructed as described above, is first positioned by inserting the bosses 55*a*, 55*b*, 56*a*, and 56*b* of the housing of the receptacle connector 5 into the apertures K2*a*, K2*b*, K2*c*, and K2*d* of the printed circuit board K2 and then fixed by soldering the lead portions 64 of the contacts 60 to the circuit pattern of the printed circuit board K2.

In this condition, the fixtures 58 of the receptacle connector 5 are soldered onto the grounding pathways K2*e* of the printed circuit board K2, and the receptacle connector 5 is firmly fixed on the printed circuit board K2. At the same time, the shell 53 is grounded (or earthed) through the contact bosses 53*e* of the contact portions 53*d* of the shell 53 as the contact bosses 53*e* are in contact with the fixtures 58.

As mentioned previously, as the shell 53 and the fixtures 58 are constructed as separate parts, the shell 53 is plated with nickel while the fixtures 58 is plated with a solder. The nickel plating is to improve the durability of the shell against wear and tear which may be caused by repeated mating or insertion and removal with a matable connector, and the solder plating is to make easy the subsequent soldering of the receptacle connector 5 to a printed circuit board. In this way, the productivity of the fabrication of the receptacle connector 5 can be increased while the electrical connection between the shell 53 and the fixtures 58 is maintained.

Furthermore, even though the contact portions 53*d* of the shell 53 and the embedded portions 58*b* of the fixtures 58 are not provided with any resiliency, the contact portion and the embedded portion are kept firmly in contact with each other because they are press-fit into and retained in the slots 51*c* and 51*d* of the housing main body 51, which has some resiliency. Even if any outside force should act on the contact portion 53*d* or on the embedded portion 58*b* in a direction to depart one from the other, they will not part from each other. Because of this firmness, the construction of the contact portion 53*d* and the embedded portion 58*b* may be made even simpler. It is not necessary to provide the contact bosses 53*e*, and such parts can be provided instead on the embedded portions 58*b* of the fixtures 58.

With the plug connector 1 and the receptacle connector 5, which are constructed as described above, even while both the connectors 1 and 5 are not yet mated, the shell 13 or 53 of each connector 1 or 5 is individually connected to the grounding pathway of the respective printed circuit board K1 or K2. When both the connectors 1 and 5 are brought into engagement, the plug contacts 20 and the receptacle contacts 60 are electrically connected, and, at the same time, the grounding pathways of both the printed circuit board K1 and K2 are electrically connected with each other through the connector.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical connector comprising:

an insulative housing made of an insulating material, including a laterally extending main body, an engaging portion, and fixture retaining slots, said engaging portion protruding forward from said main body to engage with a matable connector, and said fixture retaining slots extending through said main body in a vertical or to-and-fro direction near lateral ends of said main body;

fixtures made of an electrically conductive metallic material, said fixtures being press-fit into said fixture retaining slots of said insulative housing and being used to fix said insulative housing on a circuit board; and a shield made of an electrically conductive metallic material, including a peripheral portion and contact portions in a one-piece body, said peripheral portion surrounding a perimeter of said engaging portion, and each of said contact portions extending from said peripheral portion to a respective fixture retaining slot;

wherein:

said fixture and said contact portion are retained in contact with each other in said fixture retaining slot, establishing electrical connection.

2. The electrical connector as set forth in claim 1 wherein said fixtures are plated with a solder, which is used for soldering said fixtures to said circuit board, and said shield is provided with a hard plating, which hardens a surface of said shield.

3. The electrical connector as set forth in claim 2 wherein said hard plating is a nickel plating.

4. The electrical connector as set forth in claim 1 wherein a contact boss is provided on each of said contact portions such that said contact boss protrudes toward said fixture which is positioned in a respective fixture retaining slot; and when said fixtures are press-fit into said fixture retaining slots, said fixtures come in contact with said contact bosses.

5. The electrical connector as set forth in claim 1 wherein:

said fixture comprises an embedded portion and an insertion portion in a one-piece body, and when said embedded portion is press-fit into and retained in a respective fixture retaining slot of said insulative housing, said insertion portion protrudes downward from a lower face of said insulative housing; and when said insulative housing is mounted on said circuit board, said insertion portion is inserted into and engaged with an aperture which is provided on said circuit board such that said insulative housing is firmly fixed on said circuit board.

6. The electrical connector as set forth in claim 1 wherein:

said fixture comprises an embedded portion and a plate-like mounting portion in a one-piece body, and when said embedded portion is press-fit into and retained in a respective fixture retaining slot of said insulative housing, said mounting portion protrudes downward from a lower face of said insulative housing and bends in a "L" figure to further extend along said lower face; and when said insulative housing is mounted on said circuit board, said mounting portion is surface-mounted onto a grounding pathway of a circuit pattern which is provided on said circuit board such that said insulative housing is firmly fixed on said circuit board.

* * * * *